US005595133A

United States Patent [19]

Bullard

[11] Patent Number: 5,595,133

[45] Date of Patent: Jan. 21, 1997

[54] UNDERWATER VIEWING SURFACE WATERCRAFT

[76] Inventor: Marc D. Bullard, P.O. Box 720322, Orlando, Fla. 32872

[21] Appl. No.: 573,581

[22] Filed: Dec. 15, 1995

Related U.S. Application Data

[63] Continuation of Ser. No. 385,766, Feb. 8, 1995, abandoned, which is a continuation-in-part of Ser. No. 134,975, Oct. 13, 1993, abandoned.

[51] Int. Cl.[6] ..... B63B 35/00

[52] U.S. Cl. ..... 114/66; 441/135

[58] Field of Search ..... 114/66, 123, 352–354; 440/54, 6; 441/129, 135, 136; D12/300, 308, 317

[56] References Cited

U.S. PATENT DOCUMENTS

| | | | |
|---|---|---|---|
| 3,085,356 | 4/1963 | Wayfield | 441/135 |
| 3,137,873 | 6/1964 | Garrolinil | 441/74 |
| 4,598,659 | 7/1986 | Chinnery | 114/123 |
| 4,691,658 | 9/1987 | New | 114/66 |
| 4,840,592 | 6/1989 | Anderson | 441/135 |
| 4,895,539 | 1/1990 | Bender | 441/135 |

OTHER PUBLICATIONS

Crystal Boats publication, date Unknown.

*Primary Examiner*—Edwin L. Swinehart

[57] ABSTRACT

An air-to-water surface operating underwater viewing craft which succeeds in providing man with both speed and the same extravagant vision for underwater viewing that he/she possesses above the water with respect to field of view and clarity. This is achieved through proper implementation of a number of factors which are all locked in a perpetual relationship one to the other. The desired results are obtained by employment of a viewing window which is laterally curved around the sides of a prone viewers' face and which extends foreward and backwards sufficiently to exceed mans' field of vision threshold in all directions. The viewers' head is supported by a headrest which provides a viewing reference point for the viewers' eyes. Around this arrangement is built a flotational device which features two stabilizing pontoons positioned on starboard and port sides providing correct craft posture and predetermined draw. A two axis joystick controls two retracting electric thrusters providing full maneuverability. A viewing window curved on only one axis featuring a unique structural stabilizer, and electric thrusters which retract into their respective pontoons work together to provide speed and viewing performance that makes this invention stand alone.

11 Claims, 16 Drawing Sheets

UNDERWATER VIEWING SURFACE WATERCRAFT

RELATED APPLICATION

This application is a continuation of Ser. No. 08/385,766, filed Feb. 8, 1995, now abandoned which is a continuation in part of Ser. No. 08/134,975, filed Oct. 13, 1993, now abandoned.

BACKGROUND—FIELD OF INVENTION

Since before mans' earliest records, his desire to overcome the elements in almost every way still persists today. From habitat to walking on the moon itself we have overcome the obstacles and pushed back the elements intervening with merely a dream. Many dreams concerning the ocean are alive and well today, from mastering its unbridled surface to revealing the secrets of its deepest abyss. From complex unmanned robotic submarines to the simple snorkeling mask, man has met the elements with devices of his inspiration in efforts to see and learn. Probably no dream of the ocean is so common or strong, however, as the one which pleases man so greatly; to observe its limitless splendor, whatever it be that he may find. His dream is of an ethereal window though which he sees completely and naturally, as above the water, without limitations.

Of the number of devices which operate at the waters' surface (air-to-water) as does this invention, the most relevant of prior art are described in U.S. Pat. Nos. 4,895,539/4,840,592/4,691,658 as well as the disclosed applications enclosed. While these devices are fine examples of our American ingenuity, they unfortunately fail to fulfill the needs of the viewer due to failure in recognizing and correctly responding to a latent yet inevitable relationship existing between all the factors below. these are the keys to preserving complete human vision underwater as well as high craft speed, and each invariably affects a number others, thus must be properly implemented;

1) Window shape (accommodating side-to-side field of view most prominent in human vision and disposing itself to axial waterflow) 2) Position of viewers' eyes 3) Window size (must equal or exceed mans' human reference boundaries relative to distance from viewers' eyes) 4) Window element thickness (dictates degree of distortion therefore optical quality) 5) Structural integrity of viewing window (structural vulnerability increases proportionally with-speed) 6) Number of viewing elements/partitions viewed through (fewer the better e.i. less light refractive surfaces @2 per element) 7) Basic draw (hydrodynamic displacement) 8) Varying waterline (submersion of viewing window to its edges critical, therefore effects of number of viewers/contents becomes important) 9) Sectioning planes' internal elevation (must exceed waterline elevation to prevent leakage) 10) Elevation of viewers' body (lower the better putting viewer under waterline at a slight incline).

Nowhere in prior art are all of these elements in relation to each other uniquely implemented to provide the superior results of complete human vision for underwater viewing and high craft speed achieved by this watercraft invention.

An investigation of prior art will not only reveal absence of intent to provide man with both high craft speed and limitless visual power with respect to field of view and to clarity in the same vehicle, but a number of additional disadvantages. The more important of these disadvantages which prior art and the disclosed publications suffer are:

(a) They suffer substantially inferior fields of view, and rarely if ever even address the existence of such problem in the art even though it is the most relevant. One afternoon of viewing with any of these devices will quickly reveal the relevancy of how much vision is delivered vs. desired. (In fact the first time an object moves outside your field of view).

(b) Also, the cases which solve the optical partitioning problem (viewing window) with a singular element suffer the most inferior field of view. Those with more than one element suffer distortion (due to magnification or warped imaging), closure inaccessibility in the case of leakage or fogging (due to a number of causes including leakage), user unfriendliness in or outright prohibitive to using photographic equipment and recording the experience, or any combination of all of these.

(c) In no case in prior art does the viewing window bring water and window so far around the sides of the prone viewers' face, or capture the large cache of field of view man possesses downwardly from his normal vector of straight ahead line of vision by passing it under the prone viewers' body (nearly one half of it in fact in this particular embodiment). This reveals absence of intent to provide complete human vision for underwater viewing. Viewing window curvature on two axes in any prior art produces certain distortion and shape which is unfavorable for waterflow associated with high speeds.

(d) All prior art cases capable of high rates of craft speed or reasonable transport utility (at worst) suffer severe handicaps in field of view or distortion or both. Lack of implementation of single axis curvature (lateral) of a singular viewing element of minimal symmetrical thickness in conjunction with an effective window stabilizing trait dictates that prior art can never obtain the complete and unlimited performance achieved by this invention.

(e) All prior art cases capable of high speeds pose a threat to both swimmers and marine life in that they utilize an outboard main motor capable and even likely of inflicting well documented damage upon contact with a body, marine life, or reef formations.

(f) Every example of prior art suffers inferior performance in photographing the experience due to physical inaccessibility of photo equipment, severe field of view limitations, distortion (magnification, warped imaging, etc.), or any combination or all of these.

(g) Finally, none of the inventions in prior art which are large enough to need a trailer for transport solve the stubborn problems inherent with a device of this nature facilitating releasably sectioning the craft. This negates both transporting and storage inconveniences and their costly additional expense.

OBJECTS AND ADVANTAGES

Accordingly, several of the more important of the advantages of my invention are:

(a) The viewer enjoys the same extravagant allowance of clarity and field of view for underwater viewing that he/she is endowed with above the water, and in full comfort from salt or fresh water, swimming fatigue, breathing restrictions and water menaces such as sharks, jellyfish and coral vulnerabilities inherent with snorkeling/diving. This invention actually exceeds mans' visual capabilities.

(b) Another advantage is the employment of a singular window element of a minimal symmetrical thickness. This simplicity affords optimized visual quality free from distortion from lenses, light refraction off multiple surfaces and magnification or warping.

(c) This invention provides a sound solution for the structural vulnerability this special viewing window inherits as a trade-off-for its high performance. A removable viewing window stabilizing apparatus dramatically increases the hydrostatic trauma the window element is capable of withstanding to far exceed that necessary to travel at extremely high rates of speed. This invention therefore negates any compromise fromerly thought necessary by those experienced in the art in either viewing quality and completeness, or velocity performance, and both are enjoyed by this single invention rather than two which are normally dedicated exclusively to one primary capability or function.

(d) The shape and position of the viewing window in this invention permits natural and undisturbed axial flow of water along its outer surface permitting high rates of speed without incident.

(e) Further object and advantage in preserving and embodying the reference of complete human vision stated above is the profound psychological effect this has on its viewer. The absence of mentally taxing resistance to viewing efforts is both overwhelming and fulfilling, while other devices dictate the delivery of only a limited and often disappointing portion thereof (especially where exotic ocean scenes are concerned).

(f) This inventions' viewing element can be easily accessed (its entirety within arms reach of the viewer) and wiped clean or dry should water make its way past its protective bow splash cover into the closure, or if leakage should occur.

(g) Another distinct advantage and object of this invention is its designed ability to effectively utilize dual propulsion means for two separate capabilities; quiet electric propulsion for viewing underwater, and powerful internal combustion propulsion for high speed transport to and from viewing areas. Retracting the electric thrusters into the pontoons eliminates them as a speed retarding appendage while using the main engine.

(h) It is the further advantage of this invention to provide an underwater viewing surface watercraft which is profoundly benign to swimmers, marine life such as manatees and fish, and coral reef formations by utilizing a main motor featuring a jet drive unit with a fully enclosed impeller, shrouded electric thrusters with screened in propellers, and low inertial moment automatically retracting spring loaded stabilizing runners which elevate upon striking an object. All these features work together with this crafts' scanty draw to absolutely minimize possible harm upon inadvertently striking a swimmer, manatee, or harming fish or coral.

(I) Another advantage of this invention is that it can be proficiently maneuvered without rudders or extra moving parts due to the mere positioning of the thrusters on the craft and the proportioning of electrical power to those thrusters.

(j) Finally, it is the object and advantage of this invention that it be releasably sectionable (two pan hull, two pontoons) for maximum versatility and convenience in transporting (needing only a mini-truck) and storing in ones' garage or home, negating the need for a trailer or special storage area or covers and their accompanying expense.

DRAWING FIGURES

Throughout the drawings and description of the drawings, closely related parts have the same number but different corresponding alphabetic suffixes.

Figure 1:
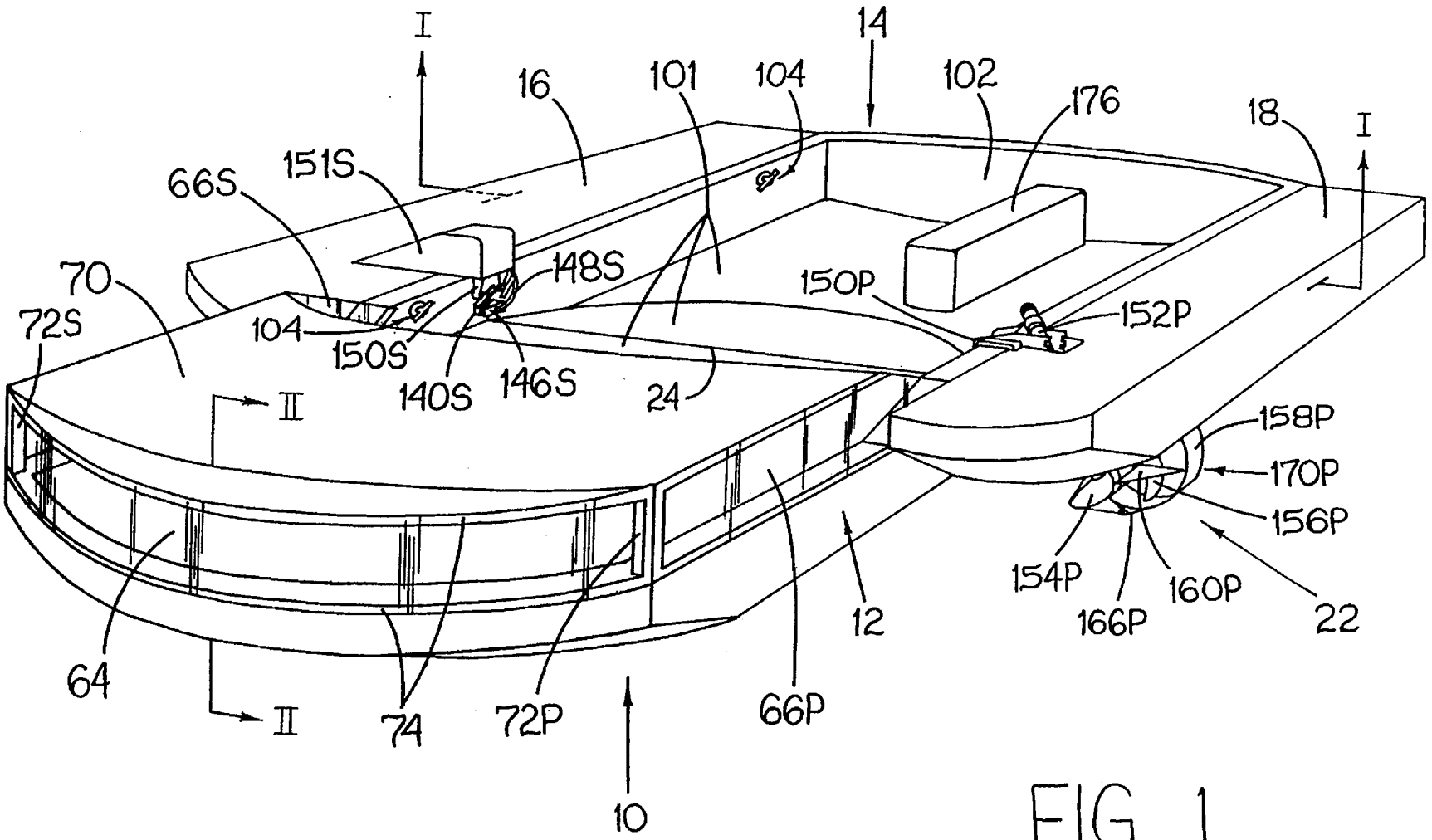
FIG. 1 is a perspective view of my invention fully assembled for use.
Figure 9A:
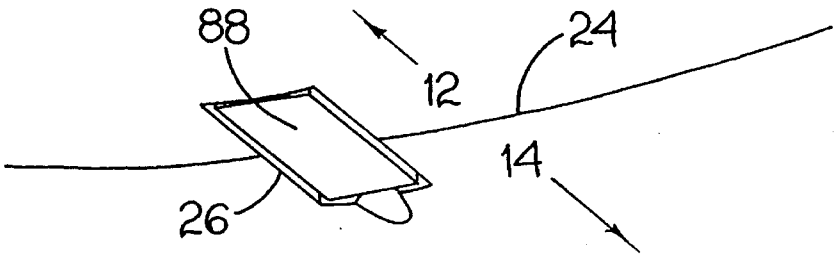
Figure 9B:
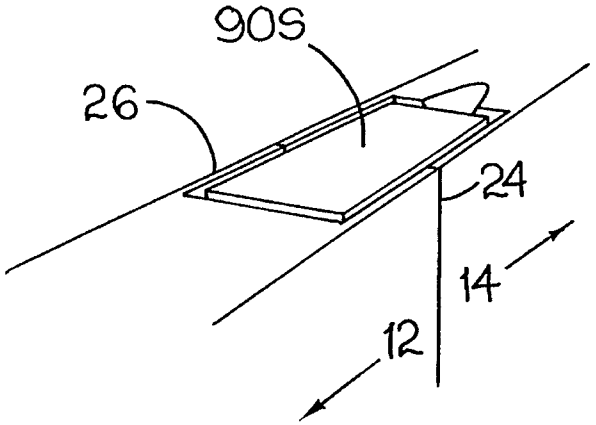
Figure 7:
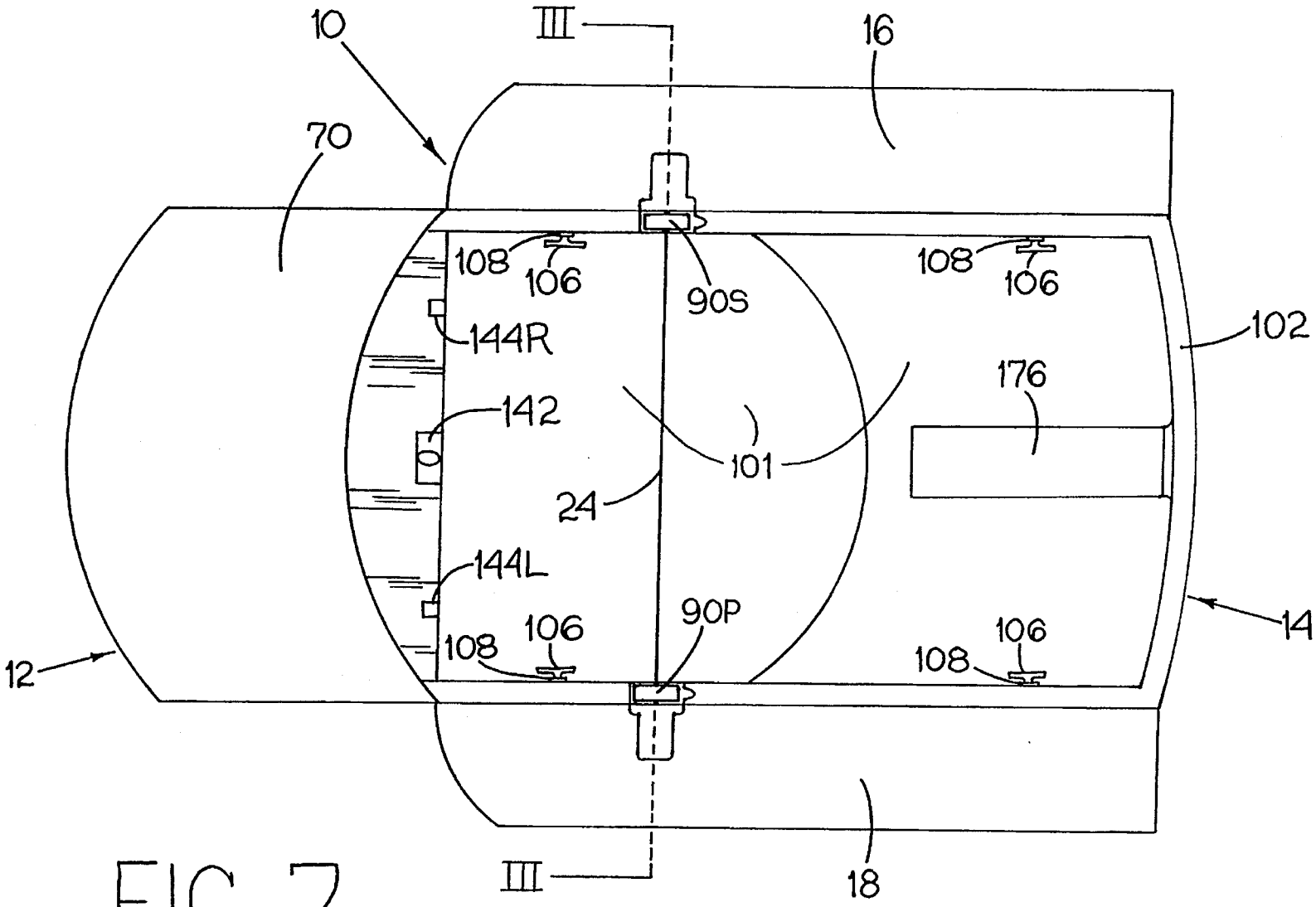
Figure 8A:
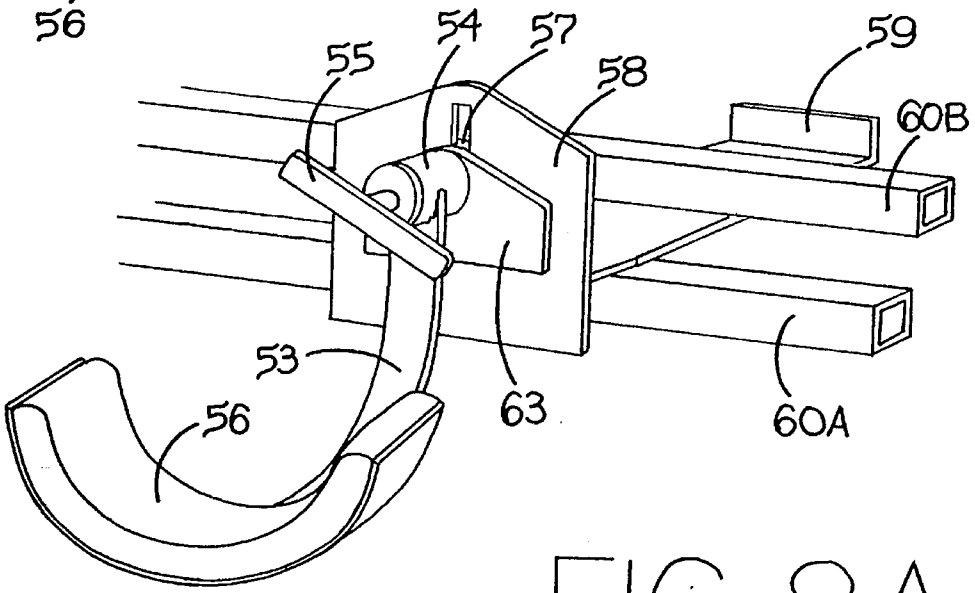
Figure 8B:
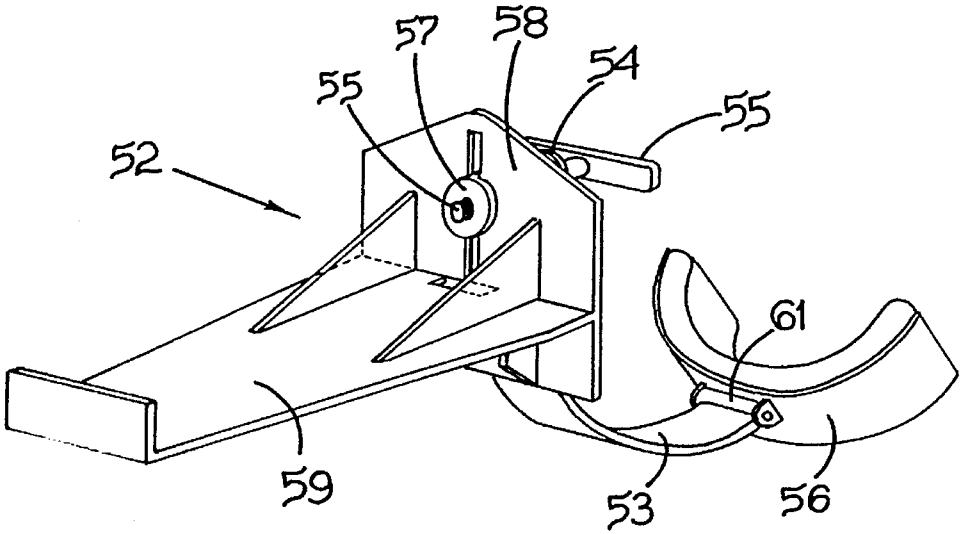
Figure 10:
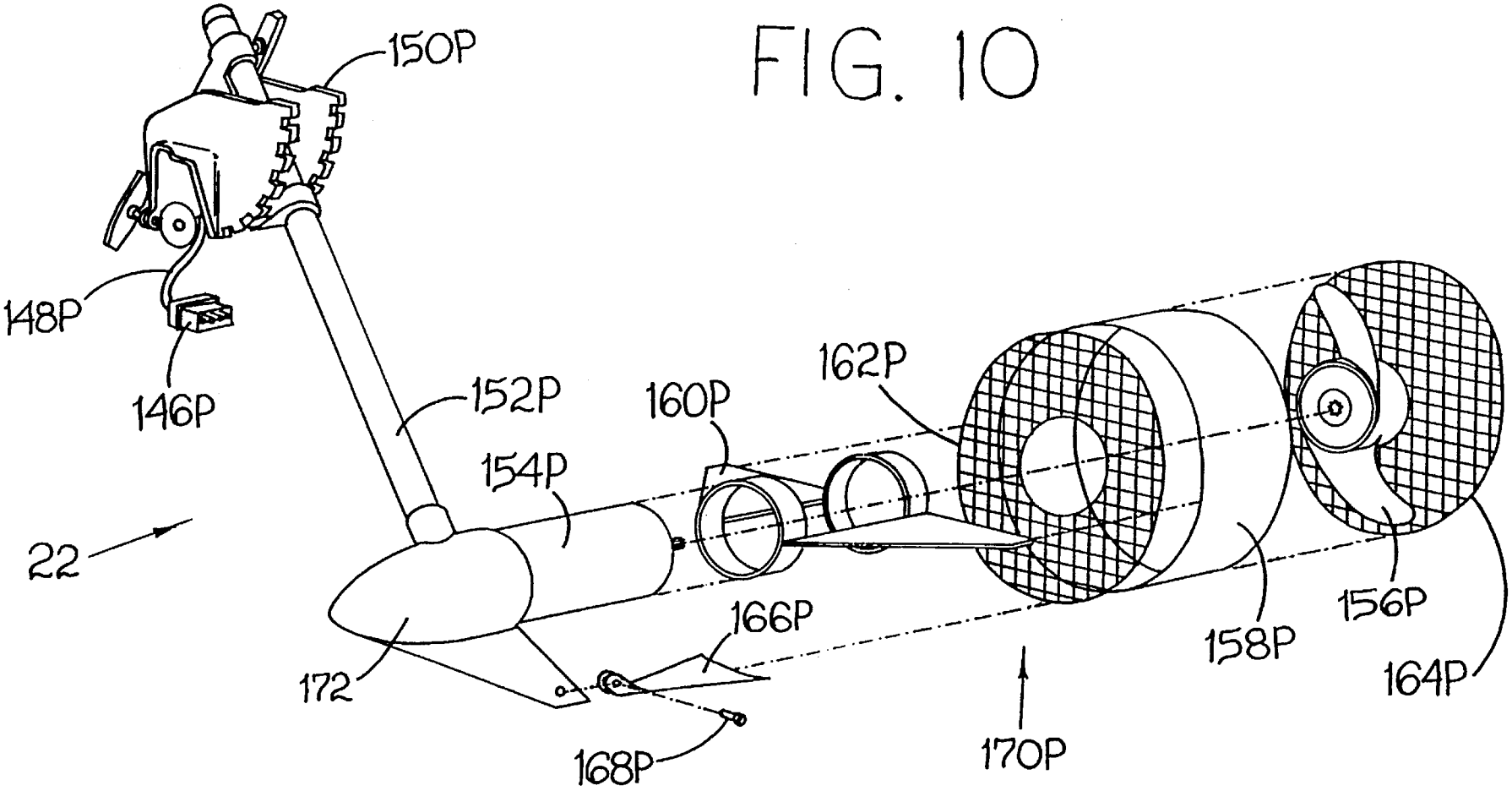
Figure 11:
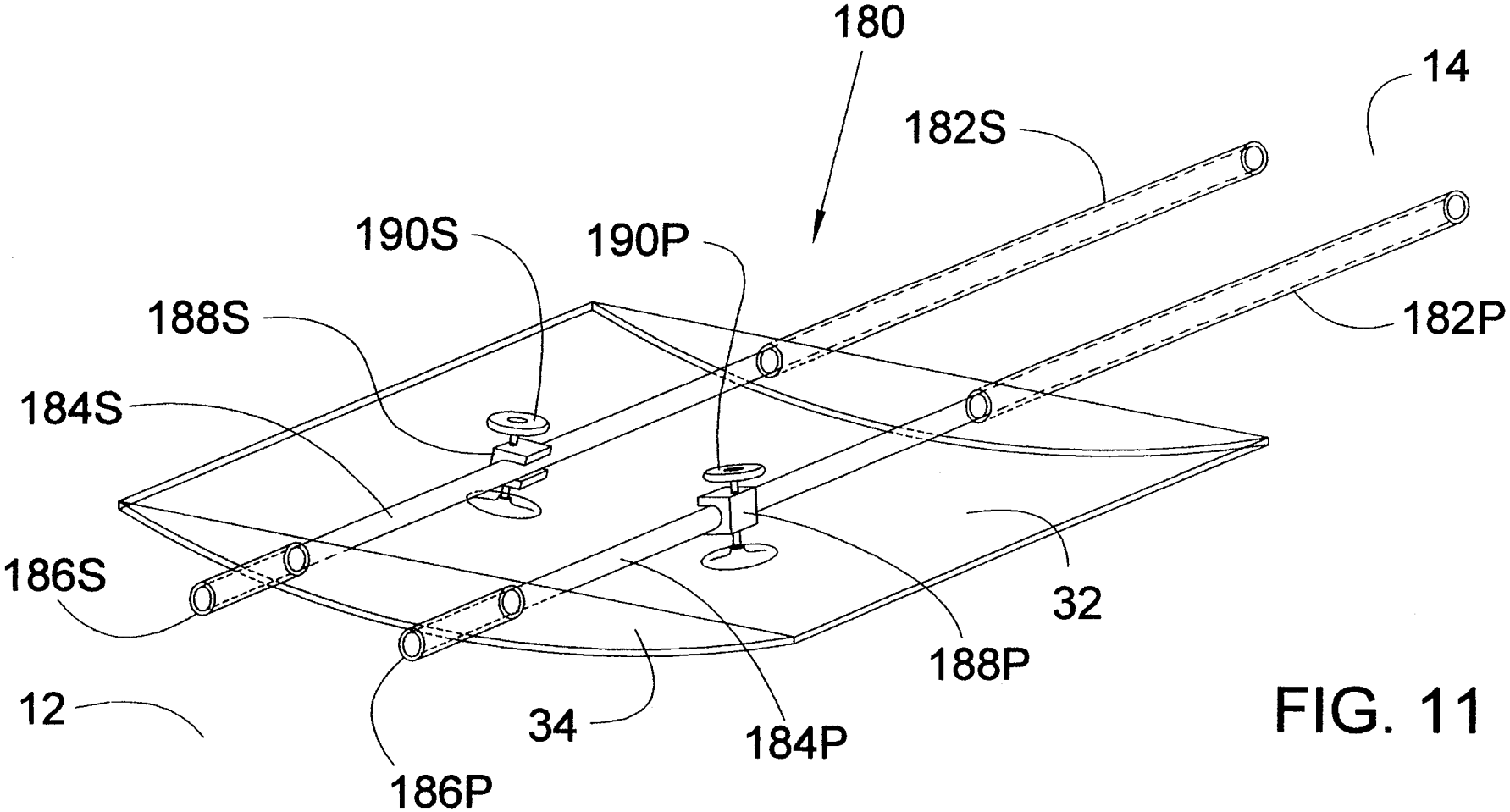
Figure 12:
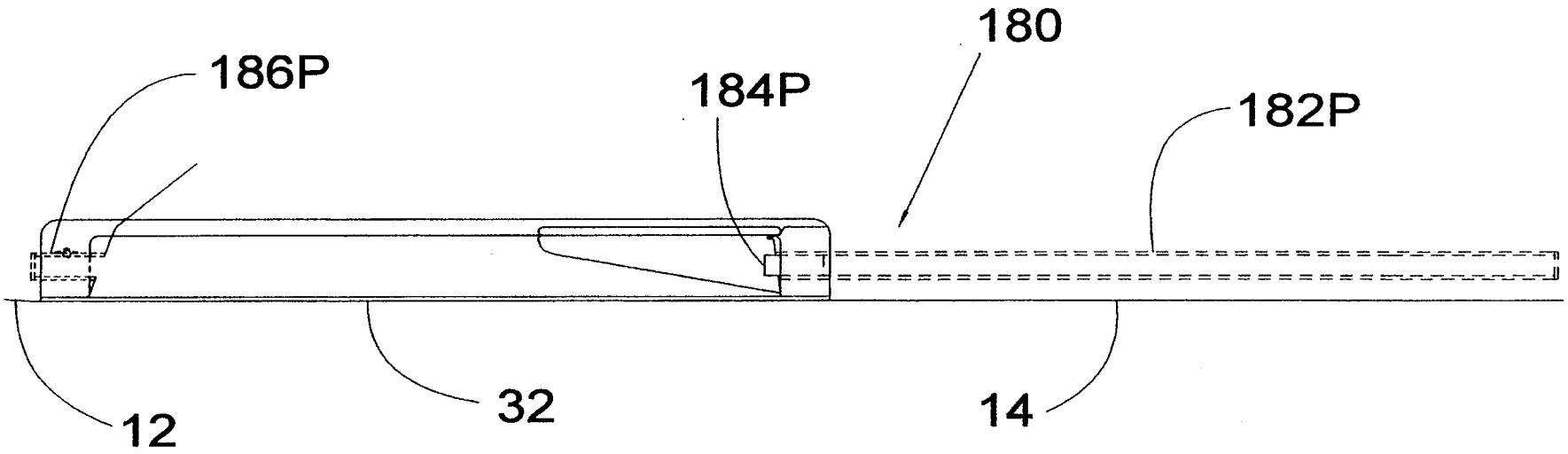
Figure 13:
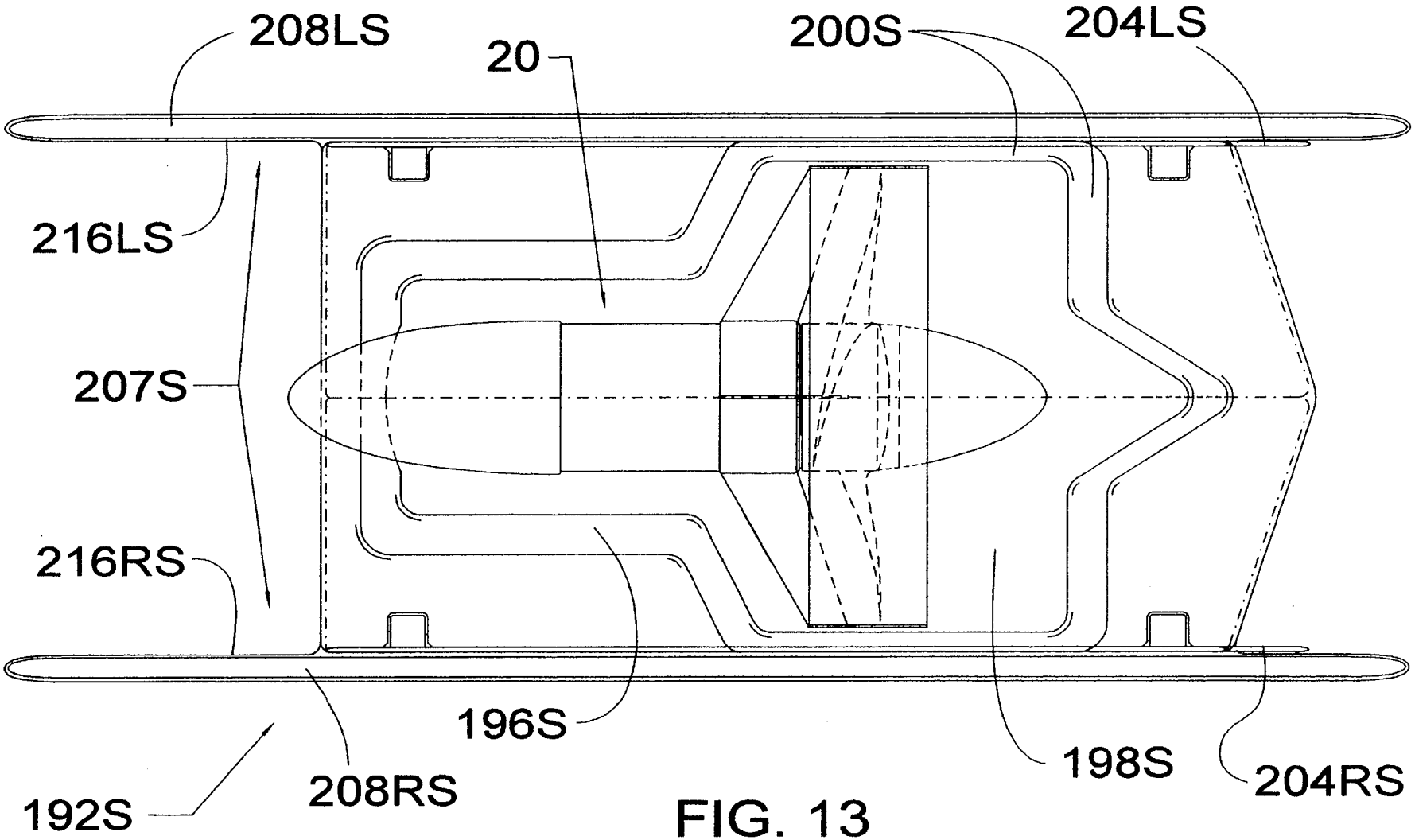

FIG. 7 is a top view of FIG. 1 showing section III, bow splash cover and surfaces only FIG. 8A & 8B are front rear detail views of the sectioning connectors FIG. 9A & 9B are perspective detail views of the sectioning connectors FIG. 10 is a perspective detail view of the symmetrical thruster assemblies FIG. 11 is a perspective view of the window stabilizing apparatus in place FIG. 12 is a side view of the window stabilizing apparatus fully retracted while viewing FIG. 13 is a bottom view of the symmetrical thruster retraction units (motors/chambers/doors)

Figure 14:
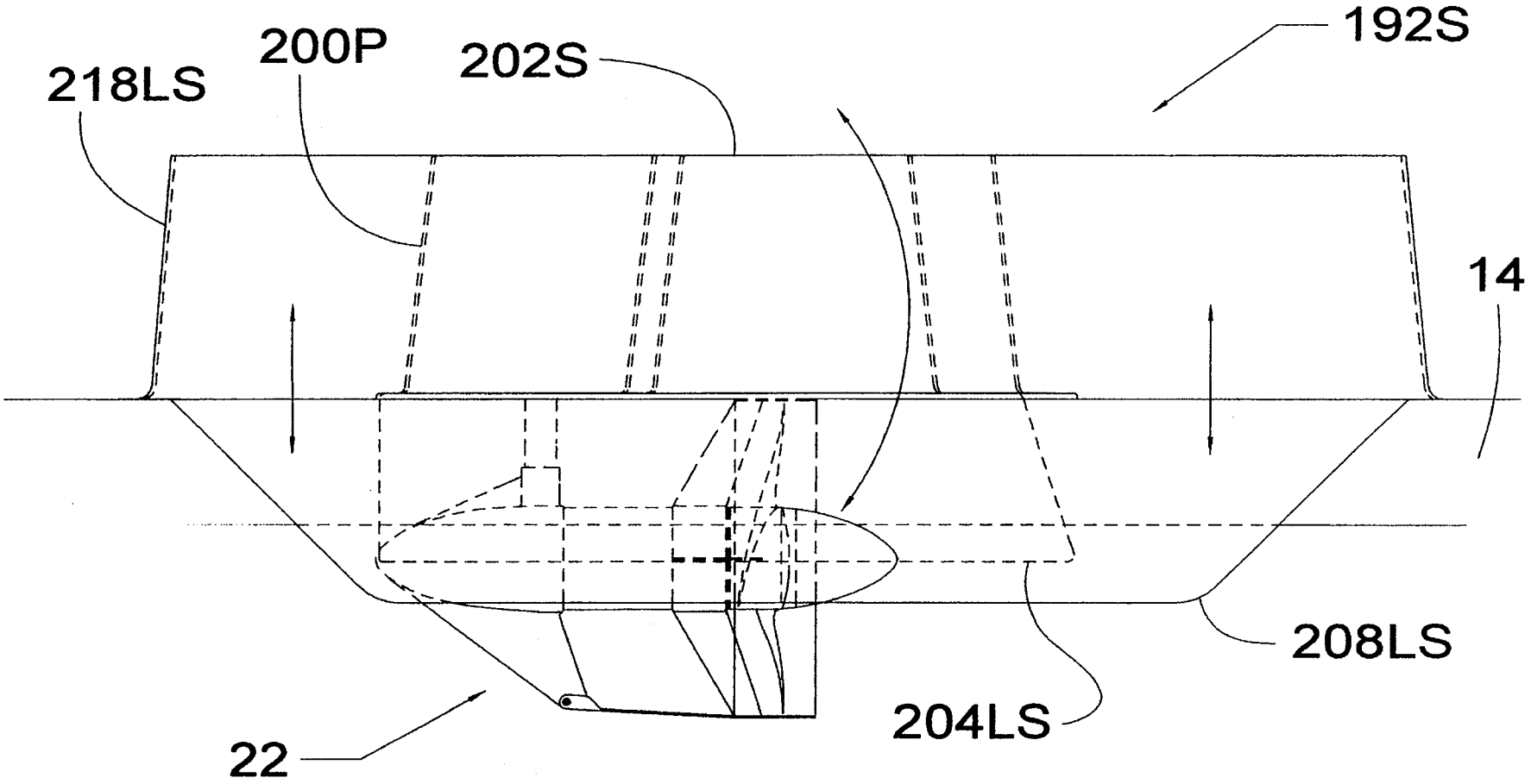

FIG. 14 is a side view of the symmetrical thruster retraction unit (complete)

Figure 15:
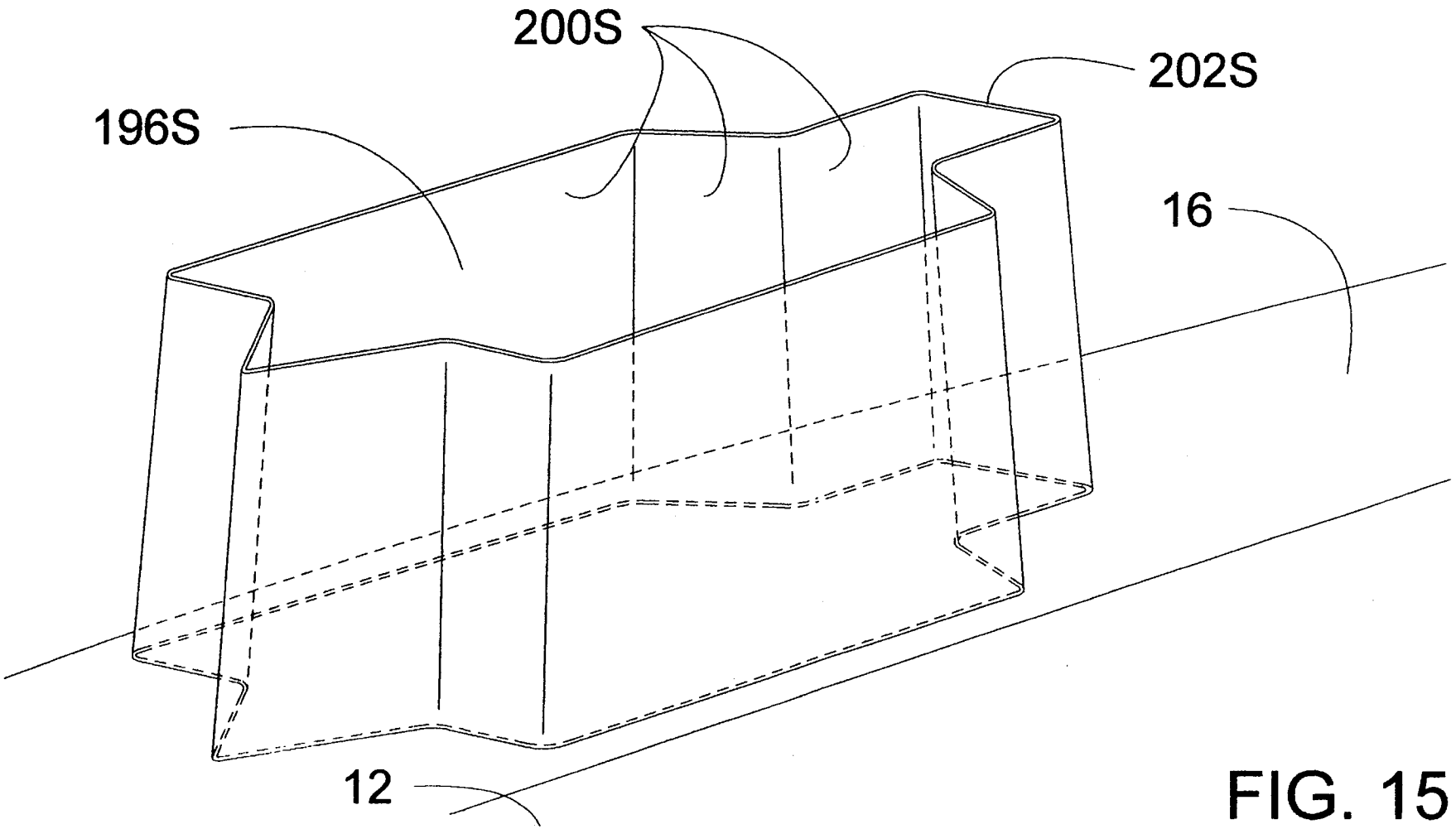

FIG. 15 is a perspective view of the thruster stowage chamber only

Figure 16:
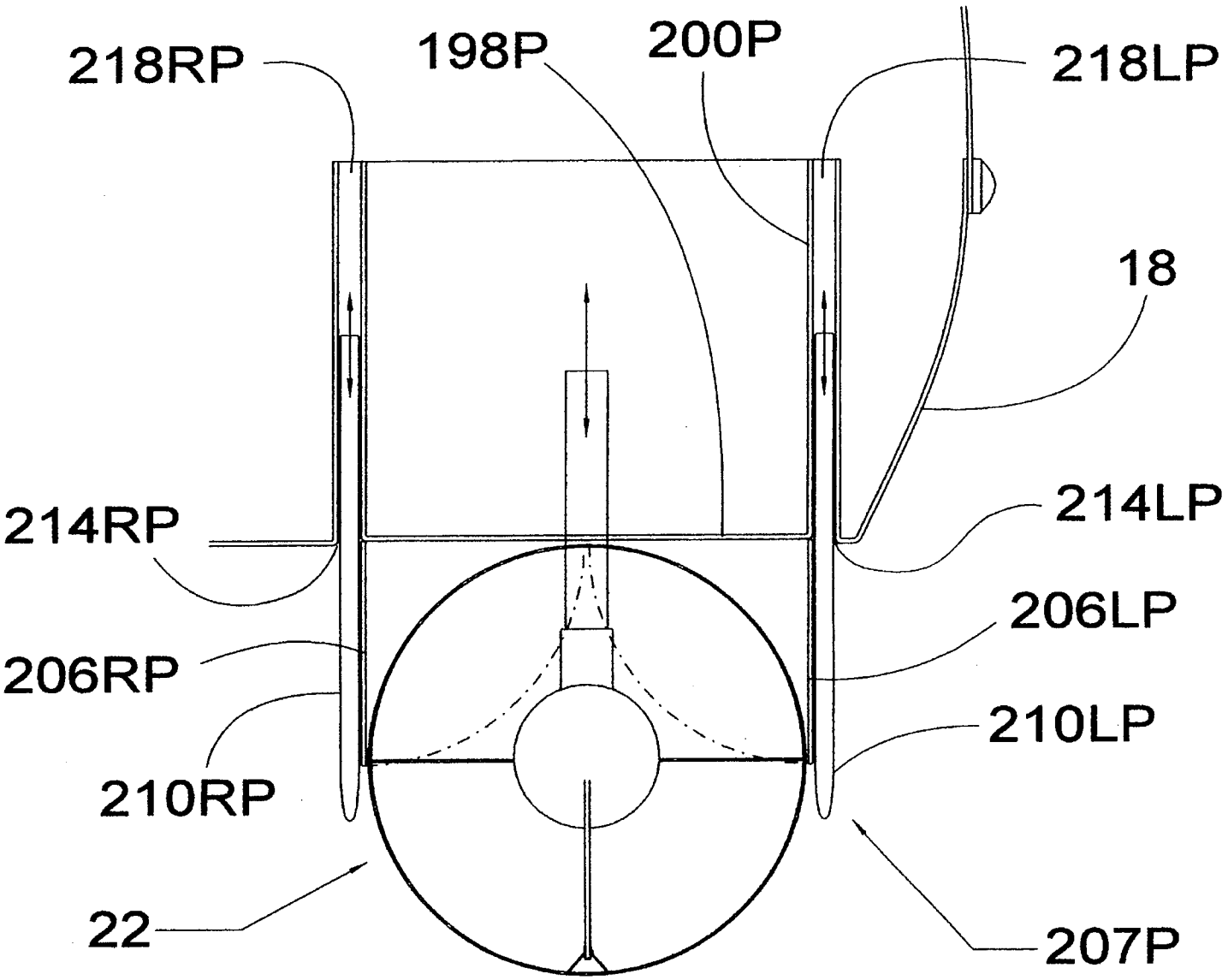

FIG. 16 is a front view of the retracting safety runner system

Figure 17:
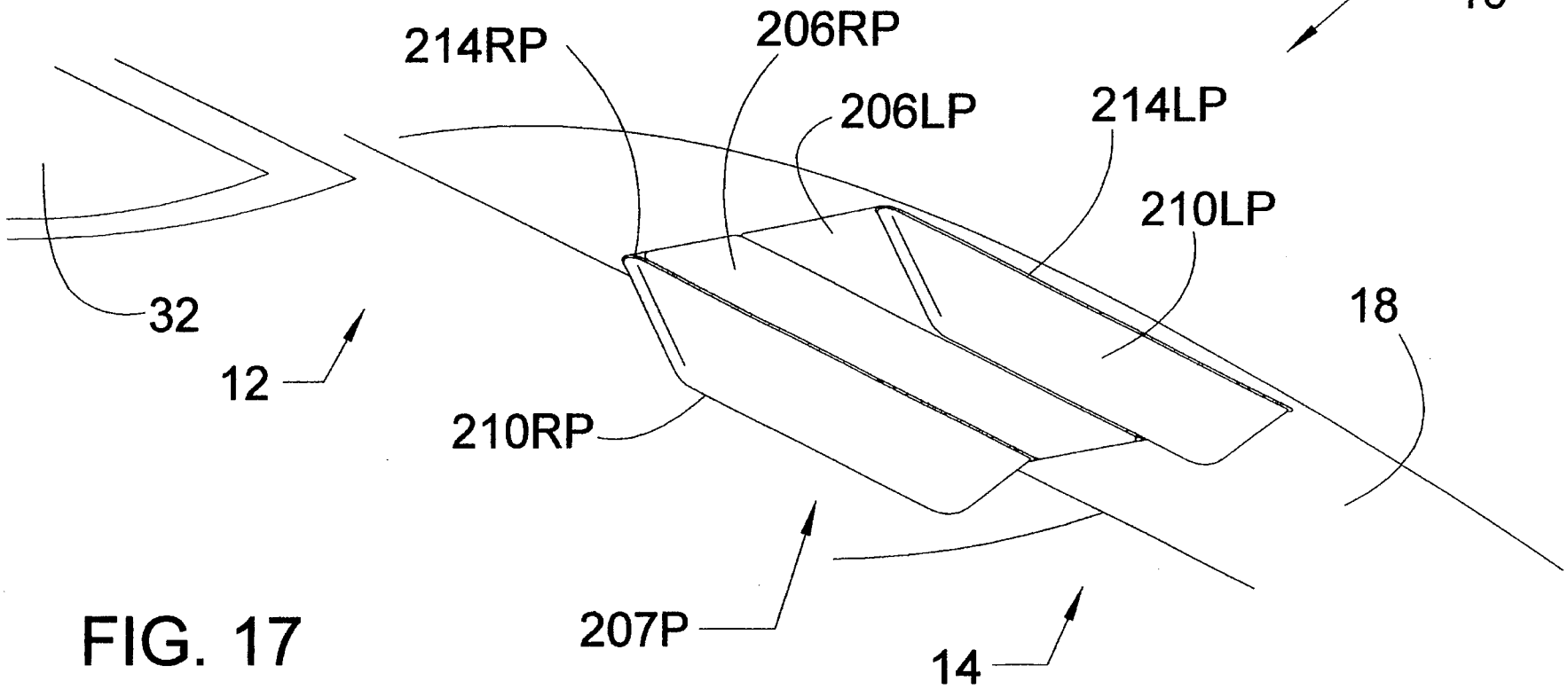

FIG. 17 is a perspective view of the retracting safety runner system

Figure 18:
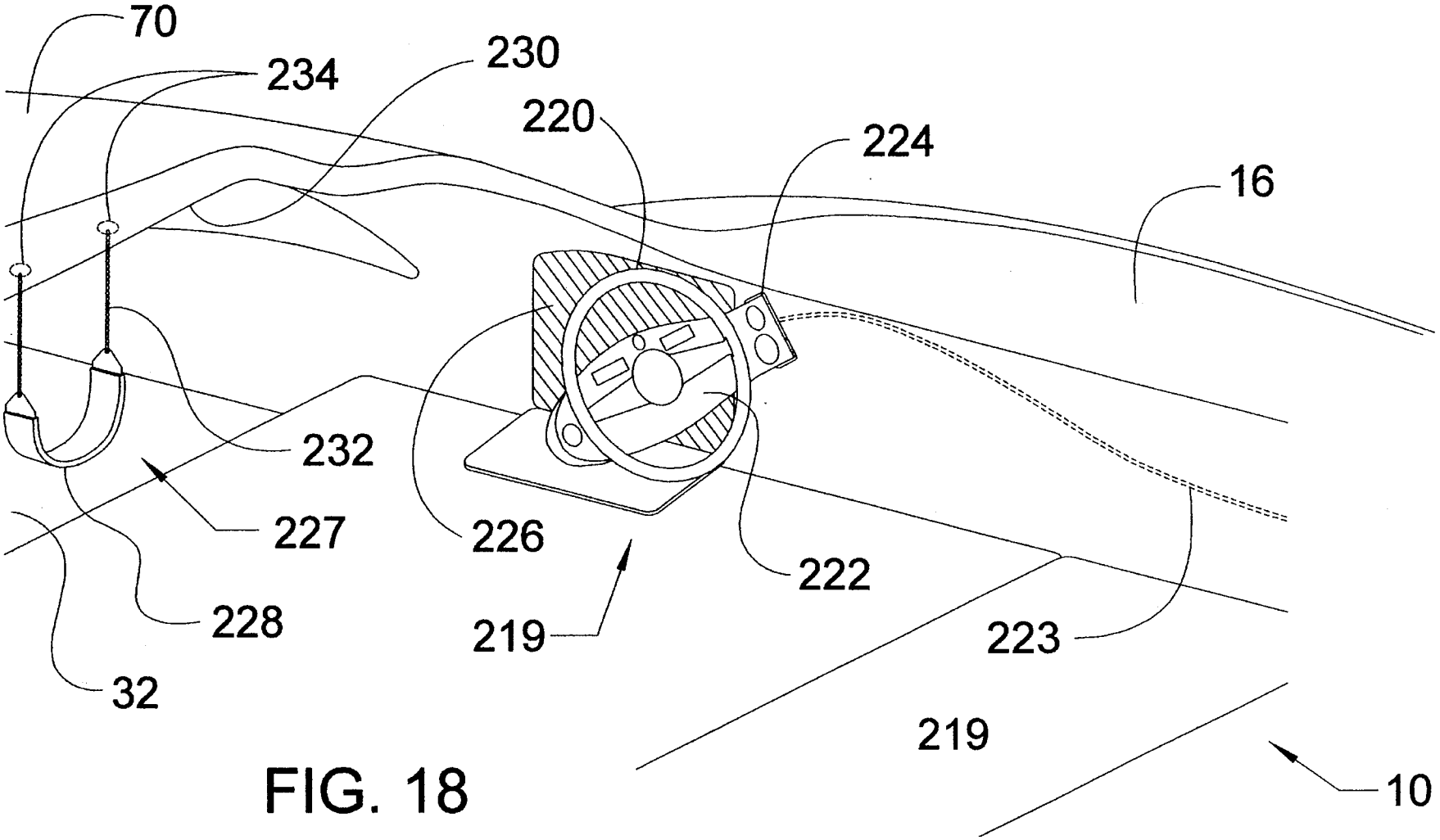

FIG. 18 is a perspective view showing both retractable steering wheel and alternative headrest assembly

DESCRIPTION OF FIGS. 1–18

FIG. 1 shows a perspective view of my invention. An underwater viewing surface watercraft 10 is shown being comprised of six releasably separable portions which are constructed primarily of a sheet plastic skin 26 (preferably ABS or acrylic PVC alloy) and a marine grade closed cell foam core 30 (preferably poly-iso-cyanurate polyurethane) fill or sandwich construction. The six portions are a bow hull section 12 and a stern hull section 14 of sandwich construction, a starboard stabilizing pontoon 16 and a port stabilizing pontoon 18 being symmetrical opposites and of foam fill construction, and a starboard thruster assembly 20 and a port thruster assembly 22 which are also symmetrical.

Figure 2:
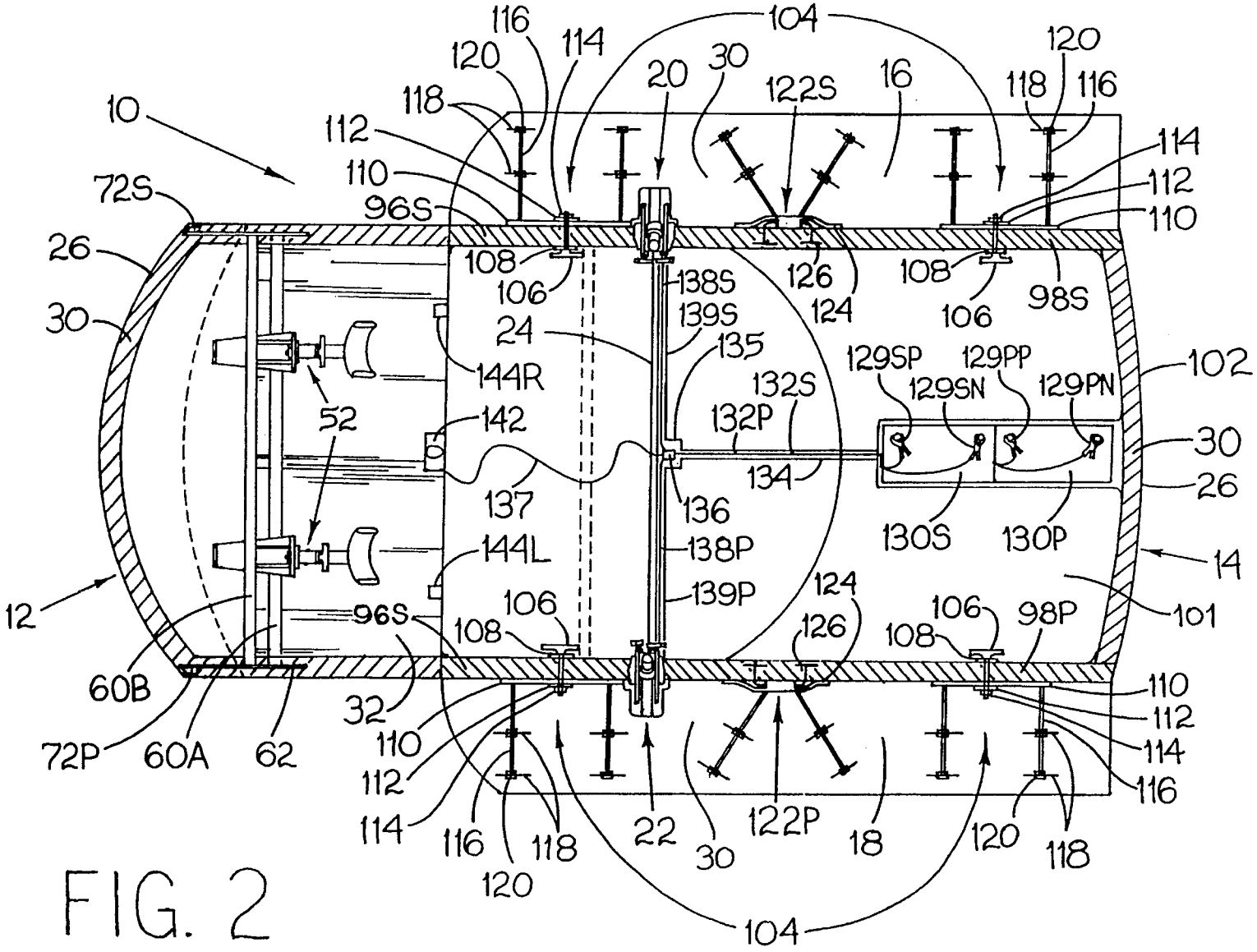
FIG. 2 is a top view of the portion indicated by the section line I (FIG. 1)
Figure 6:
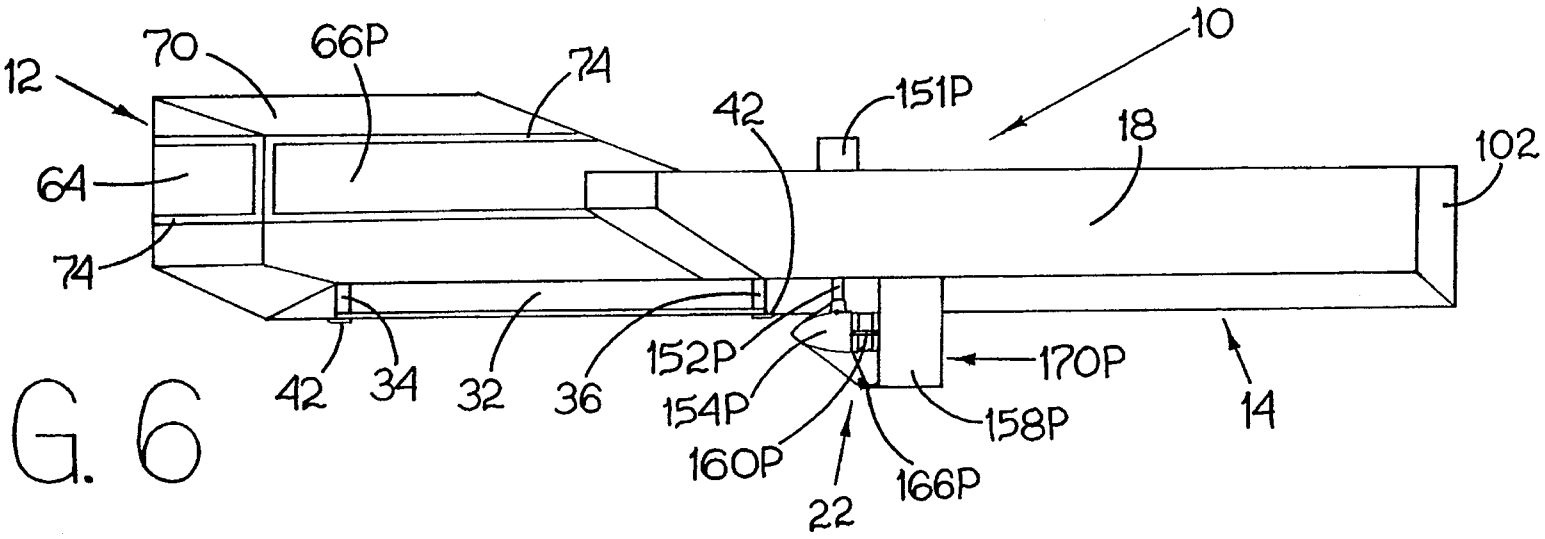
FIG. 6 is a side view of FIG. 1
Figure 3:
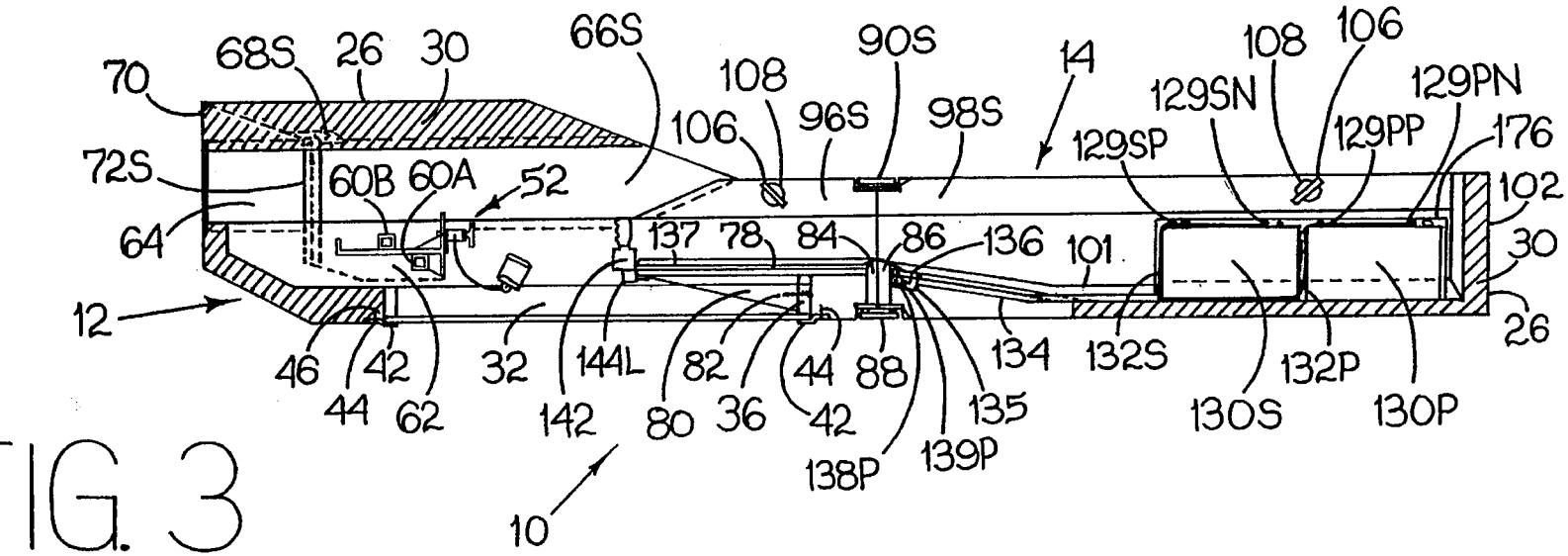
FIG. 3 is a side view of the portion indicated by section line II (FIG. 1)
Figure 4:
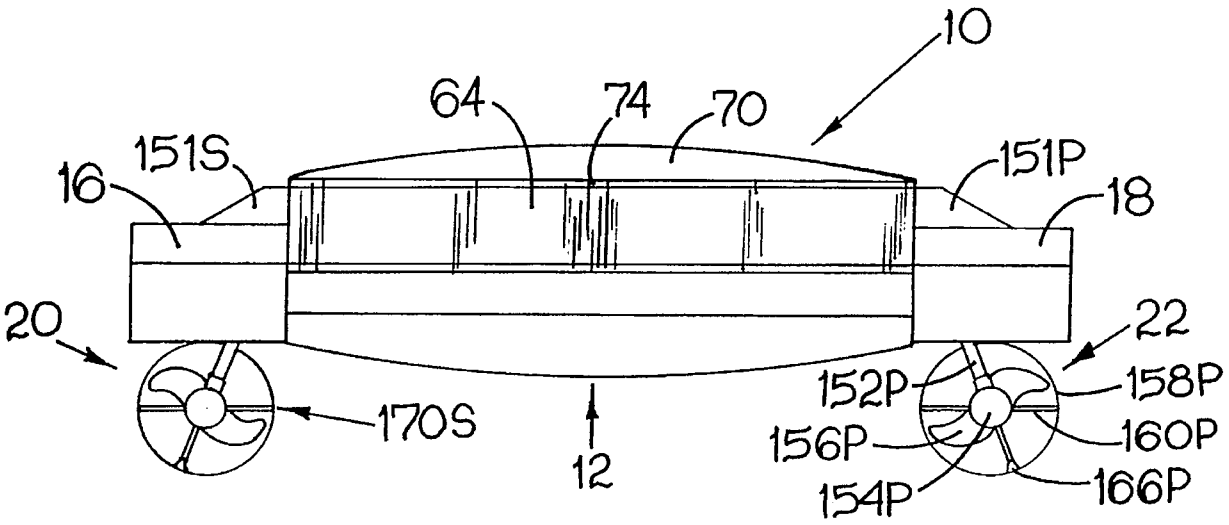
FIG. 4 is a front view of my invention
Figure 5:
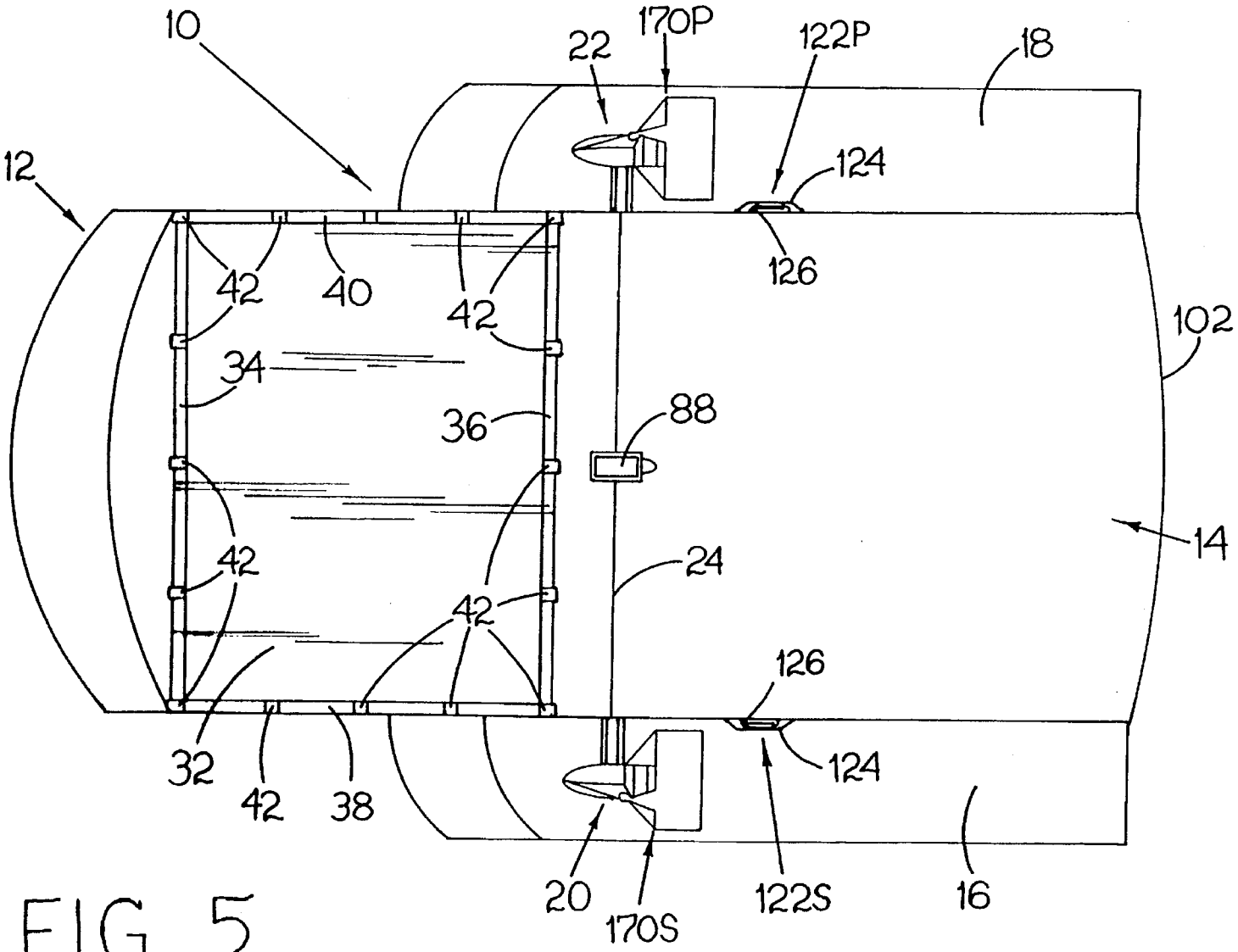
FIG. 5 is a bottom view of FIG. 1

Bow hull section 12 and stern hull section 14 are releasably adjoined to each other by conventional means of a flush mounted bottom tensioning latch 88 as shown in FIGS. 3, 5, and detail FIG. 9A positioned at the bottom outer hull surface of underwater viewing surface watercraft 10 being centered from starboard to port and bow to stern and bisected by a hull sectioning plane 24 indicated by the section line Ill in FIG. 7. A similar pair of flush mounting tensioning latches 90S & 90P being constructed of a non-corrosive material and shown in FIGS. 2, 3 and detail FIG. 9B are employed for connecting the two top portions of bow and stern hull sections 12 & 14 centered approximately half way from bow to stern and bisected by section line I in FIG. 1.

Starboard and port stabilizing pontoons 16 & 18 are releasably adjoined to bow and stern sections 12 & 14 by conventional means as shown in FIGS. 2 & 3 and begin at the outer edges of a stern 102 and advanced forward approximately two thirds the overall length of underwater viewing surface watercraft 10 to a line shared with the foremost boundary of a chest support table assembly 76.

Four of an identical upper pontoon mount assembly 104 are employed in four different predetermined locations indicated in FIGS. 2 & 3 comprising a plastic handled wing bolt 106 which passes through a washer 108, plastic skin 26, a starboard and port bow stress member 96S & 96P and a starboard and port stern stress member 98S & 98P, hull and pontoon layers of plastic skin 26, and anchor plate 110, a washer 112 and a fixed nut 114, the last four elements being incorporated within starboard and port stabilizing pontoons 16 & 18. A plurality of a long threaded anchor dowel 116, a washer 118 and a nut 120 are connected perpendicularly to anchor plate 110 and extend into foam core 30. A pontoon lower mount assembly 122 comprises a tongued anchor bracket 124 which also employs anchor dowel 116, washer 118, and nut 120 extending 60° opposite horizontal angles and perpendicularly into foam core 30, and a hull bracket 126.

Detail FIG. 10 shows a perspective view of starboard and port thruster assemblies 20 & 22 being symmetrical which are conventional electric trolling motors modified for being controlled remotely by a two-axis joystick controller 142. A starboard and port thruster mount member 150S & 150P fits over starboard and port tensioning latches 90S & 90P which are in turn mounted over and bisected by hull sectioning plane 24. When adjoined in their proper place thruster assemblies 20 & 22 are covered by a thruster mount cover 151S & 151P. A starboard and port thruster shaft 152S & 152P passes through starboard and port thruster mount members 150S & 150P and extend down and outwardly at an angle of approximately 20° (with regard to the vertical outer surface of both hull sections 12 & 14) to a starboard and port electric thruster motor 154S & 154P. Starboard and port stabilizing pontoons 16 & 18 are specially contoured for fit-up over starboard and poll thruster assemblies 20 & 22 as shown in FIG. 2 & 5. Starboard and port electric thruster motors 154S & 154P are further modified by use of a polyurethane coating 172 to seal against salt water and fitted with a stainless steel or similar noncorrosive material propeller shroud assembly 170S & 170P which consists of a propeller shroud 158S & 158P to which is adjoined by conventional means a rear thruster screen 164S & 164P, and a front thruster screen 162S & 162P being the primary mount member for propeller shroud 158S & 158P as shown in detail FIG. 10. Further stability is offered to this arrangement by employment of a propeller shroud anchor bracket 166S & 166P welded to propeller shrouds 158S & 158P and fastened to electric thruster motors 154S & 154P with a screw 168S & 168P.

These six separable portions of underwater viewing surface watercraft 10 comprise the bulk of the subservientary rotational device which embodies what is the most significant portion of the invention which may be described as follows:

Embodied within bow hull section 12 is a large viewing window 32 preferably being comprised of acrylic or polycarbonate as shown in FIGS. 5, 3 and 2 and is incorporated into bow hull section 12 by means of being formed around the curved bottom contour of bow hull section 12 and mounted to an outer mourning perimeter of appropriate material consisting of a viewing window bow mount 36, a viewing window stern mount 36, a viewing window starboard mount 38 and a viewing window port mount 40. Viewing window 32 is further attached to above mounts 34, 36, 38 and 40 by employing a plurality of a window bracket mount member 46 which is adhesively attached to viewing window mounts 34–40 and to which are attached a plurality of an identical noncorrosive window retaining bracket 42 by means of a screw 44 for case of removal due to any structural failure or scratching. Viewing window 32 is also sealed with an appropriate sealant fillet 48 for waterproofing. Viewing window stern mount 36 doubles as a bulkhead to which is attached a plurality of a support member 80A, 80B, 80C and 80D by a plurality of a screw 82 (FIG. 3) and a plurality of a compression strut 83A and 83B (FIG. 2 & 3) to which are attached a main plank 78 by an adhesive all of which comprise a chest support table assembly 76 as seen in FIGS. 2 & 3.

Chest support table assembly 76 is attached by an adhesive to bow hull section mount bulkhead 84 to which is further attached the bow portion of bottom tensioning latch 88 by conventional means. Negative space remaining is consequently filled with foam fill 30.

Just across and rearward of hull sectioning plane 24 as indicated by sectioning line III in FIG. 7 is a symmetrical stern hull section mount bulkhead 86 to which is attached by conventional means the stern portion of bottom tensioning latch 88. A leg support member 100 is attached to stern section mount bulkhead 86 and drops in elevation approximately one fifth its length throughout its length rearwardly and is contoured to the curvature of the bottom of stern hull section 14 resulting in a semicircular half moon type shape as shown in FIGS. 2, 7 & 3. The remaining portion of stern hull section 14's bottom hull from the curved rearward boundary of leg support member 100 to stern 102 is curved and of consistent thickness being of foam sandwich construction. Sections 12 & 14 are inner lined with a craft cushion 101.

Stem hull section 14 hosts two of a marine deep cycle battery 130S & 130P positioned at stern 102 end to end toward the bow and centered. A battery cosmetic cover 176 is employed over batteries 130S & 130P by sliding loosely over their top to the hull as seen in FIG. 1. A thruster power lead 132S & 132P connect to batteries 130S & 130P by conventional means of four of an identical battery clip 129SP & 129SN (starboard pos/neg) and 129PP & 129PN and extend forewardly through a conduit 134 to a thruster junction gang box 135 which contains a joystick control plug 136 and routs a starboard and port inboard thruster lead 138S & 138P toward starboard and port sides of stern hull section 14. Inboard thruster leads 138S & 138P connect to joystick control plug 136 and extend through two of an identical conduit 139S & 139P passing beneath the surface of leg support member 100 to a starboard and port female thruster plug 140S & 140P which protrude through the surface plastic skin 26 of the starboard and port side walls of stern hull section 14 as shown in FIG. 3 just bellow stern stress members 98S & 98P. A starboard and port male thruster plug 146S & 146P connect to a female thruster plug 140S & 140P and continue the electrical circuit through a starboard and port outboard thruster lead 148S & 148P to electric thruster motors 154S & 154P. A joystick control lead 137 is connected to joystick control plug 136 at thruster junction gang box 135 and extends to a two-axes joystick control 142 as shown in FIGS. 3 & 2. At the foremost boundary of chest support table assembly 76 are mounted three of an identical joystick mount bracket 144L, 144C & 144R in three different predetermined optional location as shown in FIGS. 2 & 3.

FIGS. 8A & 8B show a front and rear perspective view of a headrest assembly 52 positioned forward of the viewers' head while in a prone position and is constructed of a noncorrosive material, preferably stainless steel, which comprised a contoured forehead cushion member 56 which wraps around the forehead of the prone viewer and is connected to a support bar 53 via a cushion member hinge 61. Support bar 53 is welded to a cylindrical main swivel member 54 through which passes a manual adjustment wing bolt 55 continuing through a vertical adjustment mount bracket 58 and through an adjustment mount nut 57 securing all previously stated headrest assembly parts. Vertical adjustment mount bracket 58 is welded perpendicularly to a headrest horizontal slide bracket 59 completing headrest assembly 52 which fits loosely over a square tubing headrest mount rail 60A and under a headrest mount rail 60B constructed preferably of stainless steel, as shown in FIGS. 8A, 8B, 3 & 2. The bow side vertical surface of headrest mount rail 60B shares the stone plane with the bow side edge of viewing window 32 as seen in FIGS. 2 & 3. Starboard and port side ends of headrest mount rails 60A & 60B are welded to a bow master mount bracket 62S & 62P further constructed of stainless steel and is shared as an anchor and welded to a starboard and port splash cover support member 72S & 72P. A splash cover anchor plate 68S & 68P adjoin splash cover supports 72S & 72P to foam core 30 foam fill constructed bow splash cover 70 which covers approximately half of bow hull section 12 favoring starboard and port sides with its semicircular shape as shown in FIGS. 7 & 1. Encompassing over half the perimeter of bow hull section 12 are three elongated substantially vertical acrylic windows, namely a curved bow steering window 64, and a starboard and port steering window 66S & 66P. These are affixed to a small longitudinal portion of the outer surface of bow hull section 12 at its upper perimeter and to a similar portion around the bottom of bow splash cover 70 forming a conventional imprecation describing an inset steering window mount surface 74 throughout the perimeters of stated steering windows 64, 66S & 66P and utilizing a conventional waterproof adhesive, preferably epoxy, for attachment.

FIG. 11 shows a perspective view of a viewing window stabilizing assembly 180. One or more of a hollow stowage barrel 182S & 182P are incorporated within stern hull section 14 extending toward stern 102 from stern window mount 36 of viewing window 32 to a point far enough to fully house an elongated member 184S & 184P when retracted back within hollow stowage barrels 182S & 182P.

When extended as shown in FIG. 11, elongated members 184S & 184P enter a second of a bow hollow stowage barrel 186S & 186P which extend through and fit closely within to a predetermined point toward bow section 12 there to rest. FIG. 11 further illustrates space between elongated member 184S & 184P and the suction portion of brackets 188S & 188P fits flush onto the inside surface of viewing window 32 for secure attachment utilizing the vertical adjustment of an adjustment knob 190S & 190P.

FIG. 12 shows a side view of window stabilizing assembly 180 fully retracted illustrating the absence of any object within the scope of viewing window 32 and a slight protruding of elongated member 184S & 184P just outside of hollow stowage barrel 182S & 182P further illustrating enough of elongated member 184S & 184P to grasp and pull out and over viewing window 32 and push into starboard and port bow hollow stowage barrels 186S & 186P.

FIGS. 13, 14 and 15 show a thruster retracting system assembly 192S & 192P. FIG. 13 is a bottom view showing a chamber opening 198S & 198P within which retracts a thruster assembly 20 & 22. Thruster assemblies 20 & 22 fits between two sides of a continuous vertical surface 200S & 200P of a chamber 196S & 196P which circumvents thrusters 20 & 22. A pair of doors 204LS & 204RS are mounted longitudinally to both thruster retraction system assemblies 192S & 192P and underwater viewing surface watercraft 10. On starboard and port sides of assemblies 192S & 192P are installed a pair of safety runners 208RS & 208LS which retract vertically within a channel slot 216RS & 216LS. When open, doors 201RS & 204LS rest flush against the inside surfaces of safety runners 208RS & 208LS.

FIG. 15 illustrates the shape of the circumventing thruster retraction chamber 196S & 196P inner surface which is substantially vertical and shaped much like the top outline of thrusters 20 & 22. This surface is incorporated into the bottom surface of stabilizing pontoons 16 & 18.

FIG. 16 shows a front view of safety runner retraction system 207S & 207P illustrating their placement within craft 10 and stabilizing pontoons 16 & 18. Further illustrated is channel slot 218RP & 218LP which housed runners 210LP & 210RP when retracted vertically, and a front view of the placement of both doors 204LS & 204RS and safety runners 210RP & 210LP.

FIG. 17 shows a perspective view from below front of safety runner retraction system 207S & 207P with thruster retraction assembly doors 204LS & 204RS closed for high speed transport.

FIG. 18 shows a perspective view of both retractable steering wheel assembly 219 and alternative headrest assembly 227. Shown is a steering wheel 220 connected to a steering column 222 which is in turn connected to a steering column retraction hinge 224 which is connected to the inside portion of bow section 12 and further linked to the main motor jet nozzle by a cable 223, and steering wheel retraction system 219 swings down into an inset 226 to reside flush with the inside surface of bow section 12.

A forehead cushion member 228 is illustrated being connected to a headrest hanging member (preferably a small link chain) 232 which is in turn connected to a number of an optional headrest hanger member 234 seated into/mounted on a bow splash cover headliner 230.

While how this watercraft invention works is as profoundly simple as its only three moving parts during operation (the joystick control 142, and starboard & port electric thruster motors 154S & 154P), its theory of operation as to why it works is not quite so obvious, and is being included before describing the operation of the invention should there to this point be any question as to the validity of its most unusual claim: its ability to exceed mans' visual capabilities for underwater viewing.

THEORY OF OPERATION

Underwater viewing surface watercraft 10 in its disclosed form is the result of setting out to match and exceed the human reference of vision with respect to field of view and clarity for underwater viewing and photography.

Viewing window 32 is the result of the theoretical solution to the stubbornly persistent problem experienced by all former devices in that they intrude into mans' perceivable realm of vision (135° vertically [60° up-70° down] and 190° horizontal [95° each side]) for underwater viewing with no losses in clarity within a practical device. (Figures cited from "OPTHALMIC ASSISTANT" reference book by Dr. Jarold A. Stien, American Academy of Optomology—1983)

These angles have been accepted a minimal projections to be met regardless of the specific embodiment disclosed.

When the viewer is in the prone position and utilizing the provided headrests 52 or 227 the viewing window 32 of this invention functions as a great mask which revolves around the full front half of the human head. It is desirable that this window be larger than the minimal necessary to fulfill projections in order to offer generous viewing screen area when the viewer is propped up on ones' elbows or sitting upright when the face is far removed from its optimum position.

The viewing window 32 must be curved as little as possible to prevent distortion and minimize craft draw, must be curved/bent on as few axes as possible to prevent compounding or doubling this inherent distortion, and must be as thin as structurally allowable to further reduce and prevent distortion or imaging. The applicant has designed the invention to feature a curvature on only the longitudinal axis of the craft 10 which brings water and window both around the sides of the viewers' face extending field of view where it is most abundant within the human visual reference, and equally importantly this arrangement leaves the longitudinal outer surface of the viewing window 32 absolutely straight for uniform linear waterflow down its entirety. The fact that it is seamlessly incorporated within and along the bottom surface of craft 10 makes waterflow no different than if there were no window at all, and with window stabilizing assembly 180 installed and thrusters retracted, there are no remaining obstacles to prevent attaining the high rates of speed which this craft is capable of achieving.

Window stabilizing assembly 180 works due to elongated members 184S & 184P being constrained from vertical movement due to its seating within hollow stowage barrels 182S & 182P and bow hollow stowage barrels 186S & 186P when extended fully. Suction cup bracket 188S & 188P utilize a simple suction based principle to secure themselves to the inside surface of viewing window 32 and the "C" portion of brackets 188S & 188P slip around the top and bottom portions of elongated members 184S & 184P to secure a temporary lock of both. Once installed as seen in FIG. 11 (taking only seconds at most) the viewing window 32 is dramatically reinforced in the most critical of its structurally vulnerable points enabling it to withstand far more force than necessary to ensure that no failure occurs. The thruster retraction system pulls the thrusters up and out of the water which is to rush under the bottom surface of the invention while under speed, and makes this possible without incident.

OPERATION OF THE INVENTION

Underwater viewing surface watercraft 10 provides its unlimited subsurface visibility (water clarity permitting) by being fully assembled (FIG. 1) and placed on an appropriate body of water. A viewer then lies prone face down and rests their head (which will intentionally overhang chest support table assembly 76) in a supporting headrest assembly 52. The forehead rests in a contoured cushion support member 56 which establishes a horizontal and vertical viewing reference point for the viewers' eyes in relation particularly to the four edges/boundaries of viewing window 32.

This is what creates/permits the extravagant allowance of vision which is actually greater than what one can take in. Headrest assembly 52 and 227 are fully adjustable on three axes: forward and backward, side to side, and up and down. Forward and backward is achieved by simply sliding the unattached assembly thus or changing hooks for the chain. Headrest assembly 52 slides along the length of headrest horizontal slide bracket 59 which rests atop of headrest mount rail 60A as a fulcrum, and passes beneath headrest mount rail 60B which prevents upward motion caused by the weight of the viewers' head (and weight of the headrest assembly itself) across the fulcrum created by rail 60A as shown in FIG. 3. Side to side adjustment is achieved by simply sliding the above arrangement sideways. Vertical adjustment for distance to the window 32 and according to individual viewer comfort is achieved by manually mining vertical adjustment wing bolt 55 counterclockwise which releases the sandwiching of vertical adjustment mount bracket 58 by vertical adjustment mount nut 57 and main swivel member 54. Further adjustment of the head are possible instantaneously due to a cushion member hinge 61, and the main swivel member 54 which allows the viewer to turn his head from side to side with ease while being supported in a prone position.

Joystick control 142 may by positioned in any of three (or infinitely more if desired)joystick mount brackets 144L, 144C, and 144R as shown in FIG. 2 by simply lifting it up and out, then moving it over and fitting the engaging bottom of joystick control 142 into one of these brackets. Joystick control lead 137 is of sufficient length to facilitate reach to all three mount bracket positions from thruster gang box 135, and can remain above or below craft cushion 101 as desired.

Joystick control 142 utilizes the electronics standard within the control head of any two electric trolling motors of choice. A switch is added to the provided foreward-reverse portion of the two chosen motors which shuts off either of the two electric thruster motors 154S & 154P for side to side turns without the use of rudders or moving the thrusters themselves by simply moving the handle of joystick control 142 left or right and foreward or reverse correspondingly.

Provisions stated above allow one to four viewers (dependent upon their size) to view at once. If one individual uses craft 10, the legs can straddle batteries 130S & 130P or the main motor.

To steer underwater viewing surface watercraft 10 the viewer need only lift his/her head from headrest assembly 52 or 277 and look about, being provided steering windows 64, 66S & 66P which are low enough to not necessitate changing ones' chest and arm posture, and their predetermined placement providing no restrictions to the viewers' viewing ability, restrictions being ones' own in that physical position.

Bow splash cover 70 is positioned low enough, to see over while postured on ones' elbows in a prone position (for the average individual), and its presence prevents the intrusion of water within the critical area encompassing viewing window 32 within bow hull section 12 as seen in FIGS. 1 & 7.

To break watercraft 10 down to its six easily transportable portions one must first release starboard and port stabilizing pontoons 16 & 18 by unscrewing the four plastic handled wing bolts 106 shown in FIG. 2 and lifting up on the pontoon which releases the two halves of pontoon lower mount assembly 122. Starboard and port thruster assemblies 20 & 22 release conventionally, usually by one or two plastic handled wing bolts similar to those securing stabilizing pontoons 16 & 18, and outboard thruster leads 148S & 148P unplug at male plugs 146S & 146P and female thruster plugs 140S & 140P conventionally. Headrest assembly 52 or 227 simply lift out or unattach for storage. Retractable steering wheel 219 simply functions as a conventional steering mechanism and folds down out of the way via a steering column hinge 224 into steering wheel inset 226 when not in use.

SUMMARY, RAMIFICATIONS, AND SCOPE

This invention is a device which permits man to lie in a prone position face down and view underwater with absolutely no limitations to his visual capabilities which he naturally possesses. Field of view and clarity offered by this device actually exceeds the human reference for visual threshold. In addition to almost ethereal performance, the craft offers full mobility utilizing dual propulsion means in which the joystick controlled electric thrusters either retract into or release from the craft, and a main motor jet drive unit (being conventional) is utilized. A window stabilizing unit permits high rate of speed transport and therewith greatly expands the usefulness and practicality of the invention. This craft can also feature releasable separation of the hull into two parts, and the releasable separation of its two stabilizing pontoons and thrusters from the hull portions for convenient and inexpensive transporting and storage of the craft.

While the above description contains many specificities, these should not be construed as finite limitations of the scope of the invention and its theory, but rather as an exemplification of the preferred embodiment thereof. Variations are possible, such as an example of this craft for one viewer only, though less practical, and the fact that the craft will still function without the attachment of the stabilizing pontoons or their releasability, cosmetic appearance and styling as to make the invention appealing and aerodynamic. This invention could also be used in tow of another powered boat.

Accordingly, the scope of the invention should be determined not by the embodiments illustrated, but by the appended claims and their legal equivalents.

I claim:

1. An underwater viewing surface watercraft providing complete human vision for viewing underwater comprising:

an elongated buoyant body for supporting at least one viewer in a prone position;

a transparent viewing window mounted in the bow portion and incorporated within a bottom surface of said buoyant body, said window being crowed laterally forming a concave shape with respect to said prone viewers' face for full contact with water, and extending symmetrically in opposite directions toward starboard and port from its longitudinal centerline to two separate and corresponding points on a line drawn through said prone viewers' eyes at an angle of 95° with respect to said prone viewer's straight ahead line of vision, and the bow side edge of said window extending forward to a point on a line drawn from said prone viewer's eyes at an angle of approximately 60° with respect to said prone viewer's straight ahead line of vision, and the stern side edge of said window extends backward to a point on a line drawn from said prone viewer's eyes at an angle of approximately 75° with respect to said prone viewer's straight ahead line of vision;

a headrest member for providing vertical support for said viewer's head and vertical separation between said viewer's eye level and an inside surface of said window and establishing a vertical and horizontal reference point thereby enabling the field of view provided by said buoyant body to exceed man's visual capabilities.

2. An elongated buoyant body as set forth in claim 1 and further including;

a splash cover in said bow portion providing cover over said prone viewer's head thereby preventing the intrusion of water and providing shade from sunlight; and further comprising a plurality of elongated substantially vertical window sections mounted in said splash cover and circumscribing the perimeter of said bow portion thereby providing vision through said splash cover to steer.

3. An elongated buoyant body as set forth in claim 1 and further comprising;

a pair of pontoons mounted on starboard and port sides of said buoyant body and extending from the viewing window area to the stern of said buoyant body.

4. An elongated buoyant body as set forth in claim 1 wherein the headrest comprises;

a forehead supporting cushion member;

first and second parallel bars extending from port to starboard sides of said bow section and being located on separate horizontal and vertical planes;

a headrest adjustment bracket having a horizontal component and a vertical component, said horizontal component being unattached and slidably engaging a top surface of a first of said bars and a bottom surface of the other of said bars, said slidable engagement providing front to back and right to left adjustment of said headrest;

a manually adjustable member for securing said forehead supporting cushion member to said vertical component thereby providing adjustable distance between said prone viewers' eye level and said window enabling field of view provided by said buoyant body to exceed mans' visual capabilities.

5. An elongated buoyant body as set forth in claim 1 and further comprising;

propulsion means of an electrically operated thruster motor mounted intermediate of bow and stern of said buoyant body and beneath each of said pontoons, thereby providing proficient maneuverability without the use of rudders or said thrusters as moving parts.

6. An elongated buoyant body as set forth in claim 1 and further including;

a two axes joystick for controlling said thruster motors and providing full maneuvering capabilties with a single hand.

7. An elongated buoyant body as set forth in claim 1 further including;

a viewing window stabilizing apparatus being comprised of one or more of an elongated member of a rigid, non-corrosive material, each of said members being positioned parallel and longitudinally within said buoyant body, and being slidably insertable/retractable into a similarly shaped hollow stowage barrel extending from said stern side edge of said viewing window rearwardly toward said stern, and said elongated members while extending forward and substantially outside of said hollow stowage barrels reside a predetermined distance over and above said inside surface of said viewing window, and said elongated members enter a second number of hollow stowage barrels of a predetermined depth extending from said bow side edge of said viewing window forward toward said bow, and further comprising means for temporary attachment of said inside surface of said viewing window to each of said elongated members by use of one or more of an adjustable suction/vacuum based securing device, thereby dramatically reinforcing flexural modulus of said viewing windows' minimal symmetrical thickness, enabling said buoyant body to travel at high rates of speed without incident.

8. An elongated buoyant body as set forth in claim 1 further including;

a thruster retraction system comprising means for retracting/stowing said thrusters into/within said buoyant body through a bottom surface of said pontoons, and a starboard and port enclosure/chamber into which said thrusters retract/stow being substantially similar in size and shape to each of said thrusters, said thrusters not extending upwardly past a top edge of a substantially vertical inner surface of said enclosures/chambers circumventing each of said thrusters, said top edge being higher than the height of either of said thrusters when stowed, and starboard and port pairs of doors covering a bottom opening/entry way of said enclosures/chambers, and a pair of hinges attached to each of said doors and to said bottom surface of said pontoons for providing a flush, substantially drag free surface, said thruster retraction system thereby allowing said buoyant body to travel at high rates of speed without incident.

9. An elongated buoyant body as set forth in claim 1 further including;

a safety runner system being comprised of a number of craft stabilizing runners having a thin, elongated, flat shape and being positioned in predetermined locations, and said stabilizing runners extending downward a predetermined distance from and perpendicular to said bottom surface of said buoyant body, each of said stabilizing runners being unattached to and continuing upwardly and through said bottom surface of said buoyant body and into an elongated slot shaped channel which is hollow and incorporated into said bottom surface of said buoyant body, said slot shaped channel extending upwardly within said buoyant body and substantially perpendicular to said bottom surface of said buoyant body within which each of said stabilizing runners fit closely for vertical movement, and said safety runner system further comprising means for attachment of each of said stabilizing runners to said buoyant body for limited vertical movement of said runners through said slot shaped channels, thereby providing stabilized forward motion of said buoyant body when said stabilizing runners are in a normal, deployed position and stabilizing runners which yield to contact with any swimmer, marine life or coral formation.

10. An elongated buoyant body as set forth in claim 1 further including;

a swing style headrest member comprising a forehead cushion member and means for hanging said cushion member from an inside headliner of said bow splash cover, said headrest further featuring means for adjustment on three axes, thereby providing vertical support and a visual reference point for said prone viewers' head and eyes respectively.

11. An elongated buoyant body as set forth in claim 1 further including;

a retractable main motor steering wheel comprising a steering wheel; a hinged column to which said steering wheel is attached; and means for attachment of said steering wheel to said main motor, thereby providing steering control for the main motor while conserving space by stowing out of the way while not in use.

* * * * *